United States Patent [19]

Rhodes et al.

[11] Patent Number: 4,807,549

[45] Date of Patent: Feb. 28, 1989

[54] COLLAPSABLE ELONGATED ARTICLES INCLUDING SAILBOARDS AND THE LIKE

[76] Inventors: Stephen Rhodes, Mason St., P.O. Box 41, Bethel, Me. 04217; James E. Simon, Tanglewylde Apts, Apt. 5B, South Boston, Va. 24592

[21] Appl. No.: 630,293

[22] Filed: Jul. 12, 1984

[51] Int. Cl.[4] ..... A63C 15/05; B63B 7/04

[52] U.S. Cl. ..... 114/39.2; 114/352; 403/364; 441/74

[58] Field of Search ..... 441/1, 68, 73, 74, 79; 114/39.2, 352, 77 R, 266; 403/341, 364; 24/273; 52/589, 590, 593

[56] References Cited

U.S. PATENT DOCUMENTS

| | | | |
|---|---|---|---|
| Re. 31,167 | 3/1983 | Schweitzer et al. | 114/39 |
| 1,065,390 | 6/1913 | Palmer | 24/273 |
| 2,728,895 | 12/1955 | Quackenbush et al. | 403/364 |
| 3,137,873 | 6/1964 | Garrolini | 9/310 |
| 3,287,754 | 11/1966 | Price et al. | 9/310 |
| 3,409,920 | 11/1968 | Brownley | 441/74 |
| 3,577,576 | 5/1971 | Lobb et al. | 9/2 A |
| 3,657,753 | 4/1972 | Le Blanc, Sr. | 9/310 F |
| 3,879,782 | 4/1975 | Oliver | 9/310 E |
| 3,970,024 | 7/1976 | Fisher | 114/266 |
| 3,996,868 | 12/1976 | Schagen | 114/39.2 |
| 4,100,870 | 7/1978 | Prade | 114/39 |
| 4,253,209 | 3/1981 | Carn | 9/310 E |
| 4,255,221 | 3/1981 | Young | 156/443 |
| 4,478,167 | 10/1984 | Hart | 114/352 |
| 4,498,413 | 2/1985 | Cochran | 114/345 |

*Primary Examiner*—Sherman D. Basinger
*Attorney, Agent, or Firm*—David H. Carroll

[57] ABSTRACT

In a collapsable elongated article such as a sailboard, the several sections are joined together at respective double chevron surfaces and maintained together by a suitable clamping device. The double chevron surface is used to prevent relative movement in two axes, and the clamping device is used to retain the sections together and thereby prevent relative movement in the third axis.

6 Claims, 5 Drawing Sheets

COLLAPSABLE ELONGATED ARTICLES INCLUDING SAILBOARDS AND THE LIKE

BACKGROUND OF THE INVENTION

The present invention relates to collapsable elongated articles, and more particularly to collapsable sailboards and surfboards.

Surfboards and recently sailboards have enjoyed considerable market success as recreational vehicles. Sailboards and surfboards are commonly characterized by a single long and relatively narrow hull. A surfboard is propelled by the force produced by breaking waves, while a sailboard is propelled by the force of the wind acting on a sail. The hull must be rigid, as the occupant operates the vehicle while balancing in a standing position. Hence, the hull of these vehicles is most frequently of unitary construction, either of wood in the older models or of a composite structure in the recent models. Commonly, the composite hull will have a central core of relatively soft and/or light material such as balsa wood or foamed plastic, and a laminated outerskin made of plastic or fiberglass. U.S. Pat. No. 4,255,221, issued Mar. 10, 1981 to Young, only one of many techniques for manufacturing a composite hull. One type of sailboard is described in U.S. Pat. No. Re. 31,167, reissued Mar. 8, 1983 to Schweitzer et al.

Sailboard and surfboard hulls are quite bulky, however, rendering them portable only at the expense of special transportation structures. The difficulty of transportation has stimulated development of collapsable structures, generally of either the folding inflatable type or the sectionalized type.

An inflatable structure is disclosed in U.S. Pat. No. 3,577,576, issued May 4, 1971 to Lobb et al. The hull of this collapsable vessel is formed of a flexible sheet material such as polyvinyl chloride, and includes inflatable water tight compartments which are interconnected by channels provided to receive and retain rigid reinforcing elements. The reinforcing elements extend lengthwise through the hull and are interconnected by crossmembers. Another approach is exemplified by U.S. Pat. No. 3,657,753, issued Apr. 25, 1972 to LeBlanc. LeBlanc's collapsable structure comprises an elongated inflatable body having a flexible but substantially nonelastic and transversely convex wall, and an elongated panel adapted to be bowed and hence flexible through its width while, it is said, being longitudinally stiff. The panel overlies the top wall of the inflated body and is maintained in a correspondingly transversely bowed condition. The panel and body are capable of being longitudinaly rolled to reduce their bulk. Yet another approach is exemplified by U.S. Pat. No. 4,253,209, issued Mar. 3, 1981 to Carn. The collapsable sailboard of the Carn patent comprises one or more inflatable bladders and an envelope subdivided into plural demountable longitudinal sections. Rigifying elements cooperate with the bladders and envelope to form a demountable assembly said to resist longitudinal stress.

Unfortunately, the inflatable type of collapsable hull has not been entirely satisfactory in pratice. The reasons are legion. Inflation and deflation of such hulls tends to be time consuming, and may require a separate foot pump and repair kit. The performance of some models tends to be disappointing, either because the hull is not rigid enough for advanced techniques, or because the craft is subject to excessive wind resistence, is relatively unstable because of an elevated center of gravity, or lacks sharp edges or chine, or because inadequate or unequal pressure in one or more compartments as might be brought about by changes in ambient air or water temperature adversely effect the handling quality. Many fabrics suitable for such hulls require great care in storage and handling, and some are subject to ultraviolet and oxygen degredation. Moreover, a puncture of the inflatable structure may result in loss of bouyancy in some models. The use of a platform in some models for attaching the mast and rudder increases the complexity and weight of the hull, and introduces wear problems between fabric and platform and possibly a risk of damage due to rigid sharp structures. Moreover, the manufacturing process is expensive and variations in hull design are severly limited. In addition, some prospective purchasers might consider the inflatable type of collapsable hull to be aesthetically unpleasant.

The sectionalized hull is an alternative to the inflatable collapsable hull. U.S. Pat. No. 3,137,873 issued June 23, 1964 to Garrolini discloses a type of sectionalized hull in whch the adjoining ends of the sectionalized pieces are formed at an angle slightly offset from the perpendicular. The separable body portions are maintained in their assembled condition by means of a pair of telescoping shafts and suitable latches. In the sectionalized hull disclosed in U.S. Pat. No. 3,287,754, issued Nov 9, 1966 to Price et al., the hull sections are maintained together by pairs of laterally spaced clamp assemblies disposed on the upper and lower sides of their respective sections. Longitudinal alignment and assembly of the sections is aided by respective index pins and sockets formed in adjoining edges. U.S. Pat. No. 3,996,868, issued Dec. 4, 1976 to Schagen discloses the the use of tensioning cables extending inside of two horizontally spaced longitudinal spine tubes for retaining the sections together in operation. The tubes are joined by means of connecting sleeves at the juncture of the hull sections. Yet another approach is disclosed in U.S. Pat. No. 3,409,920, issued Nov. 12, 1968 to Brownley. In the sectionalized hull of the Brownley patent, a tapered mortise-and-tenon socket and clip arrangement is used for joining the hull sections. According to the more recently disclosure of a tandem surfer in U.S. Pat. No. 4,100,870, issued July 18, 1978 to Prade, each board of the tandem surfer includes at its coupling edge a stepped zone, which is used for reception and alignment of the individual boards to an intervening coupling member. The intervening coupling member has a mating stepped zone.

Unfortunately, the sectionalized type of collapsable hull have not been entirely satisfactory. The pin-socket type, in particular, suffers a number of disadvantages. Alignment of the sections in practice is sometimes a tedious process. The pin-socket tolerances are somewhat critical for good joint alignment. Yet the pins and sockets are subject to such problems as sand contamination, a particularly troublesome problem with respect to the socket; corrosion in some models; knicking or denting which may prevent assembly; wear in the pin and socket which permits the joint to flex; and adhesion of the dowel pins in the sockets during disassembly. A high clamping force is necessary to maintain joint integrity. In operation, the region in which the dowel pin and sockets are located suffer a concentration of stress, and dowel pin and socket themselves will suffer undue stress as the joint wears. Moreover, a flexing joint may injure the operator. During transportation, the dowel pins protrude on some models, creating a safety hazard and rendering themselves subject to damage. The use of dowel pins increases the manufacturing time and complexity.

Joining techniques have been developed for other purposes as well. The technique disclosed in U.S. Pat. No. 3, 879,782, issued Apr. 29, 1975 to Oliver was developed to couple a removable tail portion to a surfboard. The tail of the surfboard is cut out in a V-shape and provided with a grooved slot. A removable tail portion includes a flange for removably mating with the periphery of the cutout portion. The tail portion is locked to the body of the surfboard with a removable pin.

SUMMARY OF THE INVENTION

An object of the present invention is to provide sectionalized collapsable elongated articles such as sailboards having improved rigidity.

Another object of the present invention is to provide sectionalized collapsable elongated articles such as sailboards that are easily and quickly assembled and disassembled by the user.

Yet another object of the present invention is to provide sectionalized collapsable elongated articles such as sailboards that are suitable for manufacture by a variety of manufacturing techniques with minimum fabrication complexity.

These and other objects of the present invention are achieved in a collapsable article such as a sailboard hull, in which the several sections are joined together at respective double chevron surfaces and maintained together by suitable clamping devices. The double chevron surface is used to prevent movement in two axes, and the clamping device is used to retain the hull sections together and thereby prevent movement in the third axis.

BRIEF DESCRIPTION OF THE DRAWINGS

In the drawings, where like reference numerals indicate like parts.

DESCRIPTION OF THE PREFERRED EMBODIMENT

Figure 1:
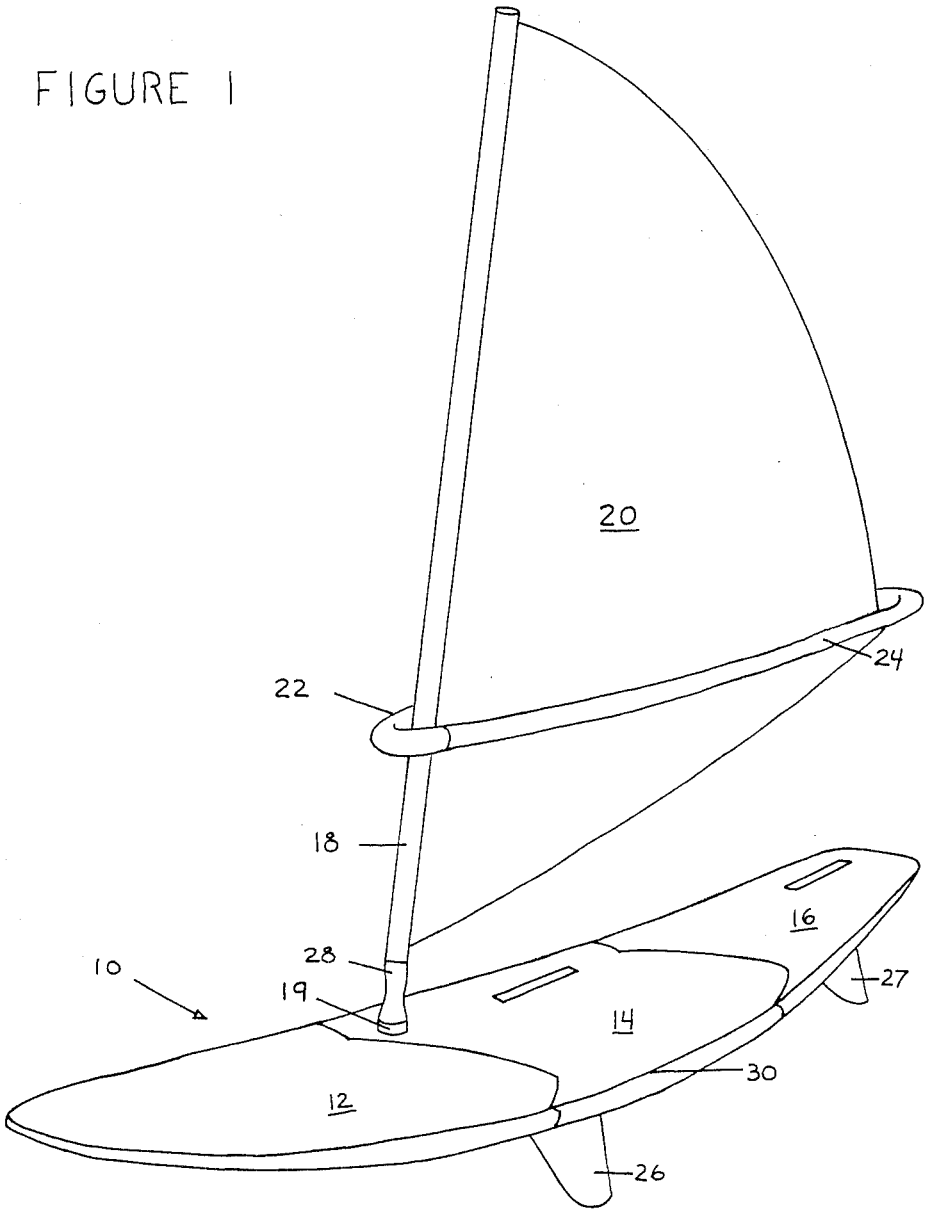
FIG. 1 is a prespective view of the fully assembled collapsable sailboard in accordance with the present invention.

A collapsable sailboard 1 in accordance with the present invention, illustrated generally in FIG. 1, includes a hull 10, a sail 20 attached to a collapsable spar 18, a detachable daggerboard 26, and a detachable rudder 27. In overall configuration, the hull 10 is not unlike a surfboard. The daggerboard 26 is inserted through an opening provided in hull 10. Daggerboard 26 projects obliquely from the bottom of the hull 10 for use as a leeboard, as is well known in the art. The spar 18, which is pivotally attached by a three axis universal joint 28 to a fitting 19, serves as a pivotal mast for the sail 20. Collapsable booms 22 and 24 are coupled to the spar 18.

Figure 2:
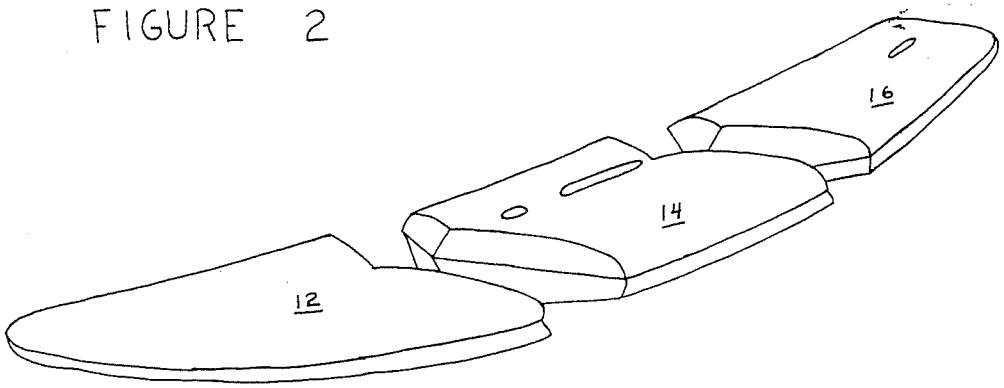
FIGS. 2 and 3 are prespective views of individual parts of the collapsable sailboard in accordance with the present invention.
Figure 3:
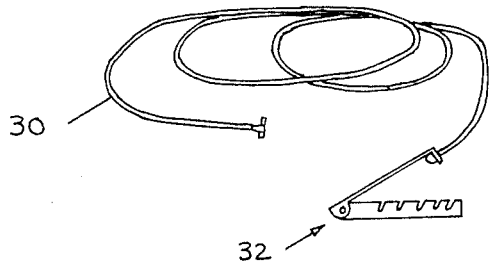

Hull 10, shown disassembled in FIG. 2, preferably is provided in three sections 12, 14 and 16, although a greater or fewer number of sections may be provided as desired. Section 12 is referred to for convenience a the bow section, section 16 as the tail section, and section 14 as the center section. The daggerboard 26 passes through an opening provided in the center hull section 14. A cable 30 extends around the periphery of the hull 10, lying within a channel suitably provided in the peripheral edge of hull 10. The cable is tensioned and held in place by a clamp 32, as described in detail below. The cable 30 and clamp 32, which are hidden in FIG. 1, are separately illustrated in FIG. 3.

Figure 4:
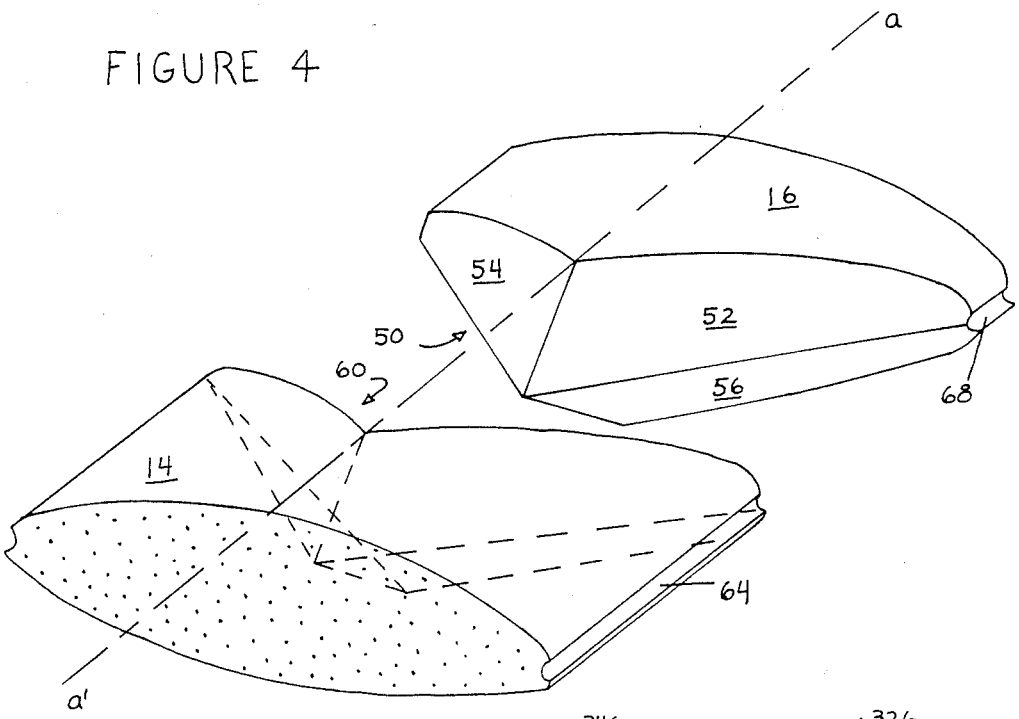
FIG. 4 is a prespective view of adjoining sections of a sailboard hull in accordance with the present invention.

The adjoining edges of the hull sections 12, 14 and 16 are provided as mating double chevrons. The adjoining edges of hull sections 14 and 16 are shown in greater detail in FIG. 4, it being understood that the adjoining edges of the hull section 14 and 16 are essentially the same. The adjoining edge 50 of section 16 comprises surfaces 52, 54, 56, and a fourth hidden surface (not shown). The adjoining edge 60 of section 14 is mated to adjoining edge 50, and includes hidden surfaces corresponding to surfaces 52, 54, 54, and the hidden surface. Channels have been formed in the peripherial edges of section 14 and 16, as indicated by visible channel 64 of section 14 and visible channel 68 of section 16.

Sections 14 and 16 are joined merely by bringing the two sections into contact with one another. Little care need be taken in aligning the sections along center line a–a', since the double chevrons are self-aligning. Sand and other contaminating matter are easily removed merely by brushing the hand across the respective adjoining surfaces. The channels provided in the peripheral edges of the several hull sections 12, 14 and 16 receive cable 30, which along with clamp 32 serve as the clamping system for the collapsable hull 10. The cable 30 is suitably dimensioned to pass within the various channels. Other clamping systems, such as local clamping devices provided on the outside edges at each joint, may be used as well.

Figure 5:
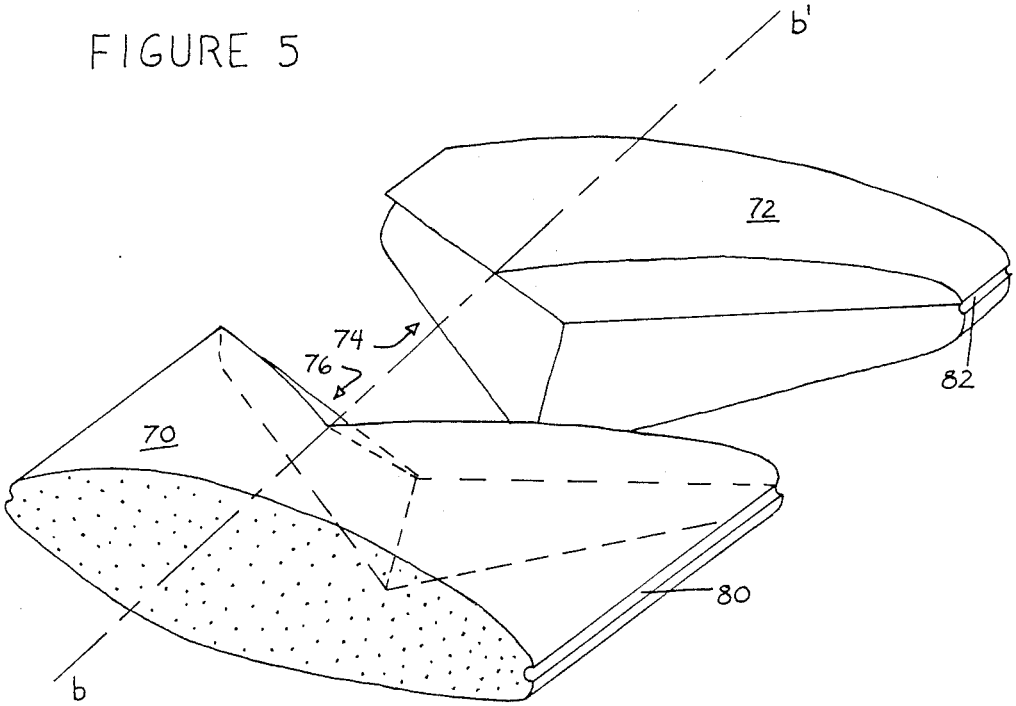
FIG. 5 is a prespective view of another embodiment of adjoining sections of a sailboard hull in accordance with the present invention.
Figure 6:
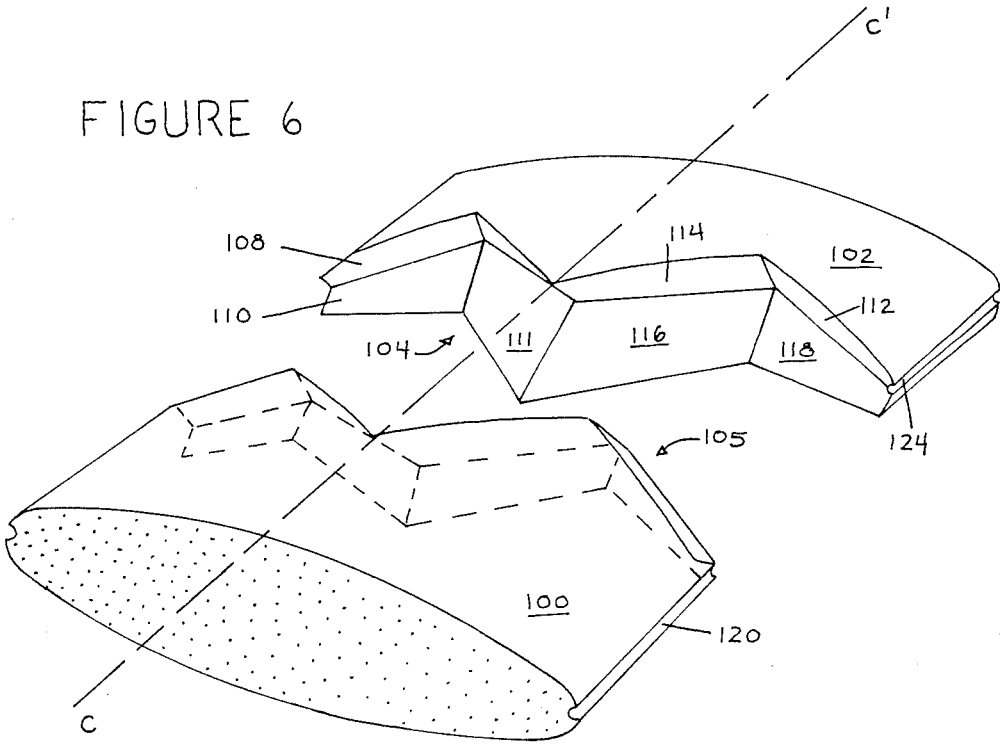
FIG. 6 is a prespective view of another embodiment of adjoining sections of a sailboard hull in accordance with the present invention.

Other arrangements of the double chevron, including compound forms, may also be advantageous. While some of these are illustrated in FIGS. 5 and 6 and described in detail below, a general definition of the term "double chevron" presently would be useful to further understanding of the present invention.

Generally, the double chevron of the present invention is a type of partitioning of a geometric structure, that results in two mating surfaces defined by the transverse intersection (not necessarily at 90°) within the structure of four or more simple surfaces. While planar surfaces are used for illustration, it will be understood that other surface contours are contemplated as well. Similarly, although symmetrically intersecting surfaces are used for illustrative purposes, it will be understood that asymmetrically intersecting surfaces are contemplated as well. When more than four surfaces define the partitioning, some of the surfaces may be parallel.

Figure 7:
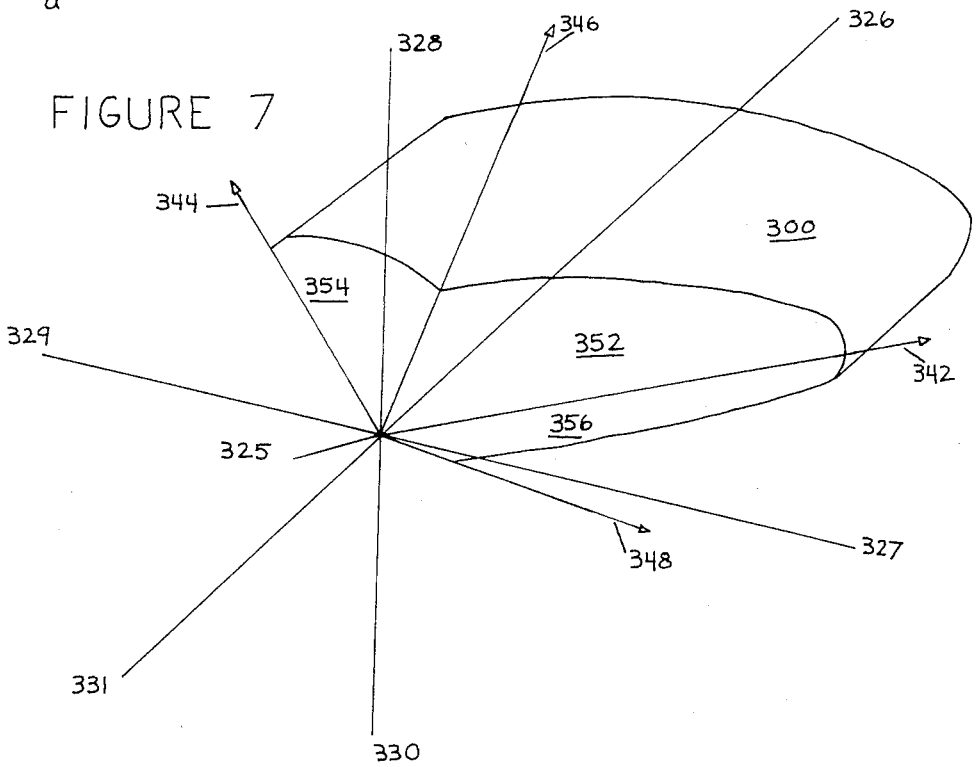
FIG. 7 is a perspective illustration used in explaining the double chevron of the present invention.

As applied to a sailboard hull structure 300 such as illustrated in FIG. 7, for example, the double chevron of the present invention results in two mating edges arising from the intersection at a point 325 within the structure 300 of four simple planar non-parallel surfaces 352, 354, 356, and a fourth surface (hidden).

The surface 352 is defined by rays 342 and 346. Ray 342 originates at the intersection 325 and extends in the positive longitudinal and positive lateral directions 326 and 327 respectively, within a plane defined thereby. Ray 346. originates at the intersection 325 and extends in the positive longitudinal and positive vertical directions 326 and 328 respectively, within a plane defined thereby. The surface 354 is defined by rays 344 and 346. Ray 344 originates at the intersection 325 and extends in the positive longitudinal and negative lateral directions 326 and 329 respectively, within a plane defined thereby. Ray 346 is described above. The surface 356 is defined by rays 342 and 348. Ray 348 originates at the intersection 325 and extends in the positive longitudinal and negative vertical directions 326 and 330 respectively, within a plane defined thereby. Ray 342 is described above. The hidden surface is defined by rays 344 and 348, both of which are described above. The double chevron illustrated in FIG. 7 is essentially the double chevron used in the embodiment of FIG. 4.

Adjoining edges resulting from another type of double chevron is illustrated in FIG. 5. Exemplary sections 70 and 72 are to be brought together along center line b–b'. Adjoining edges 76 of section 70 and 74 of section 72 are formed from rays extending (see FIG. 7) in the positive vertical and negative longitudinal directions,328 and 331 respectively, the negative vertical and negative longitudinal directions 330 and 331 respectively, the negative lateral and positive longitudinal directions 329 and 326 respectively, and the positive lateral and positive longitudinal directions 327 and 326 respectively. As previously discussed, channels are provided in the peripheral edges of section 70 and 72, as indicated by visible channel 80 of section 70 and visible channel 82 of section 72.

Adjoining edges resulting from compound forms of the double chevron also may be advantageously employed, as shown in FIG. 6. Exemplary hull sections 100 and 102 are drawn together along center line c–c'. The adjoining edge 104 of section 102 comprises a compound double chevron. The double chevron on the left comprises surfaces 106, 108, 110, and 111, while the double chevron on the right comprises surfaces 112, 114, 116, and 118. The hidden adjoining edge 105 of section 100 includes a compound double chevron that mates with the adjoining edge 104. As previously discussed, channels have been provided in the peripheral edges of section 100 and 102, as indicated by visible channel 120 of section 100 and visible channel 124 of section 102.

Figure 10:
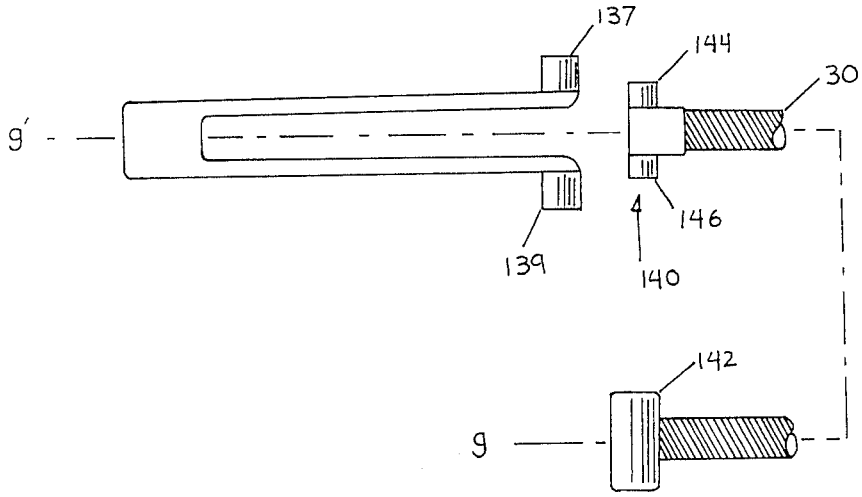
FIG. 10 is a plan view of the clamp in accordance with the present invention.
Figure 8:
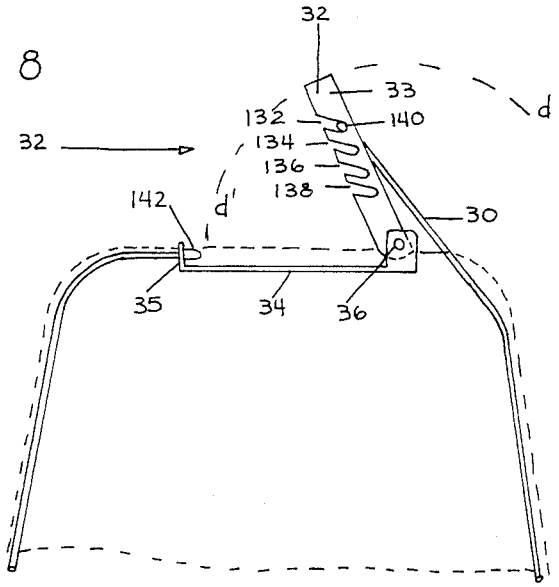
FIGS. 8 and 9 are plan views of a clamp mounted on the tail of a sailboard hull in accordance with the present invention.
Figure 9:
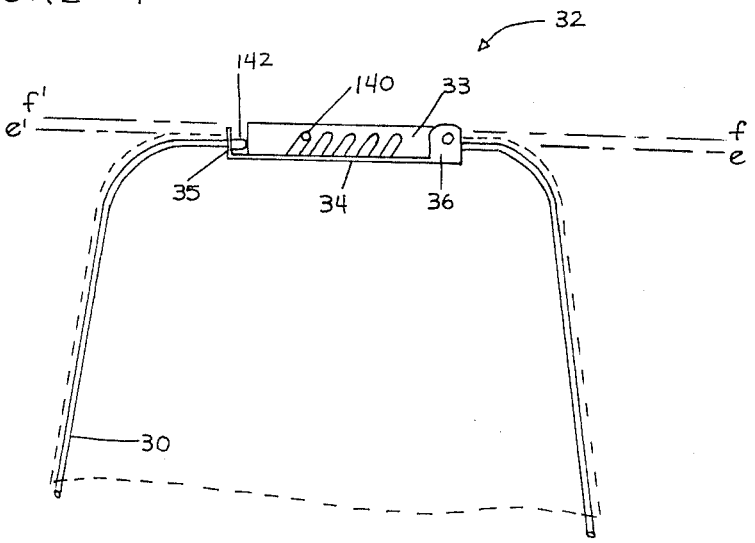

The clamp 32 is illustrated in greater detail in FIGS. 8, 9 and 10. The clamp 32 includes a lever arm 33 and a mounting plate 34. The lever arm 33 pivotally engages flanges on the mounting plate 34 by respective pins 137 and 139. The mounting plate 34 also includes a flange 35 for engaging an anchoring nub 142 provided on the cable 30, as described below. The lever arm 33 is provided with, for example, four pairs of engaging slots 132, 134, 136 and 138 for engaging pins 144 and 146 of a nub 140 provided on the other end of cable 30, also as described below.

The assembly of the collapsable hull 10 is as follows. Hull sections 12, 14 and 16 are set on a roughly level surface with all respective adjoining edges adjacent to one another. Little care need be taken in bringing the sections 12, 14, and 16 together except for brushing away any foreign matter such as sand that may rest on the adjoining edges of the hull sections 12, 14 and 16, as the sections are self-aligning. The cable 30 is grasped and wrapped around the hull sections 12, 14 and 16, care being taken to position the cable 30 in the channels provided in the peripheral edges of the several hull sections 12, 14 and 16. The mounting plate 34 is placed in a conformal recess provided at the center of the trailing edge of tail section 16, the anchoring nub 142 being in engagement with the flange 35. The nub 140 is passed through an elongated slot provided in the lever arm 33, rotated 90°, and engaged through pins 144 and 146 with a suitable one of the slot pairs 132, 134, 136, and 138.

FIG. 8 shows the clamp 32 in its open position, receiving the nub 140 of cable 30 in slot 132. The clamp 32 pivots on pins 137 and 139 along the arc d–d'. The nub 140 preferably is engaged while the clamp 32 is in this open position.

FIG. 9 shows clamp 32 in its closed position. The lever arm 33 is held closed by the tension in cable 30, which resides at a level e–e' suitably below the level f–f' of the pins 137 and 139.

A detail of the anchoring nub 142 and the engaging nub 140 is shown in FIG. 10, where the center line of the cable 30 is indicated by g–g'.

After the hull section 10 is fully assembled and clamped, the other components of the collapsable sailboard may be assembled, if necessary, and installed in conventional fashion.

While the present invention has been described with reference to a particular embodiment, it is to be appreciated that the embodiment is illustrative and that the invention is not intended to be limited to only the disclosed embodiment. Variations within the spirit and scope of the invention will occur to those skilled in the art. For example, the present invention contemplates the use of irregular double chevrons and compound double chevrons. Accordingly, variation in these and other features are contemplated and are within the scope of the present invention.

What is claimed is:

1. A collapsable elongated article comprising:

a first elongated section having a double chevron adjoining edge;

a second elongated section having a double chevron adjoining edge, the respective adjoining edges of said first and second elongated sections being mating double chevrons; and means for removably securely joining said first and second elongated sections along the respective adjoining edges thereof.

2. A collapsable hull comprising:

a first hull section having a rearward double chevron adjoining edge;

a second hull section having a forward double chevron adjoining edge, the rearward and forward adjoinin edges of said first and second elongated sections respectively being mating double chevrons; and means for removably securely joining said first and second hull sections along the respective adjoining edges thereof.

3. A collapsable hull as in claim 2, further comprising a third hull section having a forward double chevron adjoining edge;

and wherein said second hull section further includes a rearward double chevron adjoining edge, the rearward and forward adjoining edges of said second and third sections respectively being mating double chevrons.

4. A collapsable hull as in claim 3, wherein:

said first hull section comprises a board-like bow hull section having continuous longitudinally-extending channels along peripheral edges;

said second hull section comprises a board-like center hull section having continuous longitudinally-extending channels along peripheral edges;

said third hull section comprises a board-like tail hull section having continuous longitudinally-extending channels along peripheral edges; and said joining means comprises a cable adapted for passing through said channels, and a clamp mechanism for tensioning said cable therein.

5. A collapsable hull as in claim 4, wherein:

said center hull section further includes means for removably receiving a daggerboard;

said center hull section further includes means for removably receiving a spar; and said tail section further includes means for removably receiving a rudder.

6. A collapsable essentially solid board-like hull comprising:

a first elongated hull section removably mated with a second elongated hull section along respective adjoining edges defined by the transverse intersection within said hull of four simple surfaces; and means for removably securely joining said first and second elongated hull sections.

* * * * *